US005487262A

United States Patent [19]

De Waegenaere et al.

[11] Patent Number: 5,487,262

[45] Date of Patent: Jan. 30, 1996

[54] METHOD AND DEVICE FOR OVERTWISTING AND UNDERTWISTING A STEEL CORD

[75] Inventors: Johan De Waegenaere, Zwevegem; Luc Sabbe, Deerlijk; Frans Van Giel, Wevelgem, all of Belgium

[73] Assignee: N.V. Bekaert S.A., Zwevegem, Belgium

[21] Appl. No.: 224,555

[22] Filed: Apr. 7, 1994

[30] Foreign Application Priority Data

Apr. 20, 1993 [EP] European Pat. Off. ..... 93201130

[51] Int. Cl.[6] ..... D01H 7/86; D01H 13/26

[52] U.S. Cl. ..... 57/58.65; 57/10 N; 57/9; 57/67; 57/311; 57/335

[58] Field of Search ..... 57/10 N, 2.3, 2.5, 57/311, 58.57, 58.59, 58.65, 67, 68, 9, 335

[56] References Cited

U.S. PATENT DOCUMENTS

| | | | |
|---|---|---|---|
| 1,960,426 | 5/1934 | Zundorf | 57/311 |
| 2,143,417 | 1/1939 | Johannessen et al. | 57/1 UN |
| 2,546,977 | 4/1951 | Clary et al. | 57/58 |
| 3,388,541 | 6/1968 | Biagini | 57/9 |
| 3,771,304 | 11/1973 | Taketomi et al. | 57/58.57 |
| 4,299,082 | 11/1981 | Tarantola | 57/311 |
| 4,332,131 | 6/1982 | Palsky et al. | 57/213 |
| 4,385,486 | 5/1983 | Iwata et al. | 57/9 |
| 4,397,141 | 8/1983 | Gurecki et al. | 57/58.59 |

FOREIGN PATENT DOCUMENTS

| | | | |
|---|---|---|---|
| 3932433 | 4/1991 | Germany | 57/1 UN |
| 0028393 | 3/1980 | United Kingdom | 57/58 |

*Primary Examiner*—William Stryjewski
*Attorney, Agent, or Firm*—Foley & Lardner

[57] ABSTRACT

A steel cord, having steel filaments twisted so as to have a final twist pitch, is manufactured by plastically deforming the steel filaments by overtwisting the steel cord to a twist pitch which is smaller than the final twist pitch, untwisting the steel cord to the final twist pitch, further untwisting the steel cord to a twist pitch which is greater than the final twist pitch, and twisting the steel cord again to the final twist pitch. The first two steps (i.e., overtwisting and untwisting) are done under a first tension and the third and fourth steps (i.e., further untwisting and twisting) are done under a second tension which is lower than half of the first tension.

17 Claims, 1 Drawing Sheet

METHOD AND DEVICE FOR OVERTWISTING AND UNDERTWISTING A STEEL CORD

BACKGROUND OF THE INVENTION

The present invention relates to a process of treatment of a steel cord adapted for the reinforcement of rubber products, wherein the steel cord comprises steel filaments.

Steel cords are widely known and used for the reinforcement of rubber products such as tires, conveyor belts, timing belts and hoses.

In order to fulfill their reinforcement function in a proper way, the steel cords must have a high tensile strength, a sufficient resistance to compression once embedded in rubber, a good fatigue and corrosion resistance, a sufficient adhesion to rubber and a high impact resistance.

In addition to the above 'first' type of properties, which all relate to the behaviour of steel cord in a rubber matrix, the rubber industry, and more particularly the tire industry, requires the steel cords to have still further properties. These additional properties, in contrast with the first properties, relate to the processability of the steel cords when handling the steel cords during the manufacture of, for example tires. Examples of these 'second' type of properties include absence of residual torsions, straightness, absence of flare, etc.

Both the first and second types properties are supposed to be fulfilled between narrow specified limits. Conventionally, it is a difficult task, if not a rather impossible one, for a cord manufacturer to meet all these requirements.

Manufacturing a cord having all the desired properties is thwarted by the fact that, during the process of manufacturing of a steel cord, the result of measures taken to meet one property is wholly or partially nullified by measures taken in order to meet another property in the downstream part of the manufacturing process. The consequence is that a compromise must be sought or that one or more properties must be sacrified in favour of the other properties.

For example, part of the tensile strength of the steel filaments gets lost during the subsequent twisting process.

As another example, part of the degree of preforming may be lost during the downstream false twisting or during the downstream straightening.

SUMMARY OF THE INVENTION

It is an object of the present invention to facilitate the meeting of some steel cord properties.

It is another object of the present invention to make the attainment of some steel cord properties independent of the attainment of other steel cord properties.

It is still another object of the present invention to provide for a process of manufacturing a high-elongation steel cord which has a controllable amount of residual torsions and which has a controllable openness and a sufficient and controllable elongation.

It is a further object of the present invention to provide for a process of manufacturing a steel cord which has a controllable amount of residual torsions and has a sufficient and controllable openness and a sufficient and controllable P.L.E. (part load elongation, for definition see below).

According to a first aspect of the present invention, there is provided a process of treatment of a steel cord adapted for the reinforcement of rubber products. The steel cord comprises steel filaments which have been twisted to a final twist pitch.

The process comprises a step (i) of plastically deforming the steel filaments by overtwisting the steel cord to a twist pitch which is smaller than the final twist pitch;

a step (ii) of untwisting the steel cord to the final twist pitch;

a step (iii) of further untwisting the steel cord to a twist pitch which is greater than the final twist pitch;

a step (iv) of twisting the steel cord again to its final twist pitch.

In the above process, steps (i) and (ii) are done under a first tension. Steps (iii) and (iv) are done under a second tension. The second tension is lower than half of the first tension.

The terms 'process of treatment of a steel cord' do not necessarily mean that the process can only be carried out as a so-called post-treatment on an already finished steel cord. The terms 'process of treatment of a steel cord' also include processes of manufacturing a steel cord whereby the process comprises the above mentioned steps (i) to (iv) carried out on a set of steel filaments which have just been twisted or cabled in an upstream step.

Overtwisting the steel cord means twisting the steel cord until a twist pitch which is smaller than the twist pitch before overtwisting.

Plastically deforming the steel filaments by overtwisting the steel cord means that the degree of overtwisting is such that the steel filaments are deformed beyond their elastical limit. Plastically deforming the steel filaments by overtwisting may decrease the radius of curvature of the steel filaments in a controllable way. The higher the degree of overtwisting in the plastical region, the smaller the radius of curvature.

A small radius of curvature, if small enough, corresponds to an open cord structure, which allows rubber penetration even when the cord is put under a tensile tension of about twenty to fifty Newtons. This openness at tensile torsions between twenty and fifty Newton may be quantified by a P.L.E.-value in the case of single-strand constructions of the type 1 xn. P.L.E. means part load elongation and is the elongation of the cord at a predetermined tensile tension between twenty and fifty Newtons.

In the case of high-elongation steel cords, the degree of plastical deformation of the steel filaments determines to a large extent the total elongation at fracture of the steel cord.

The subsequent and downstream steps (iii) and (iv) are done in order to bring the number of residual torsions to zero or to a predetermined value.

The advantage of the present invention is that during the steps (iii) and (iv) the steel cord is not stretched in such a way that the small radius of curvature of the steel filaments is increased again. This is reached by untwisting the steel cord under a low tension, i.e. a tension which is less than half the overtwisting tension. In other words, the plastical deformation of the filaments is not substantially modified during the steps (iii) and (iv).

By way of an example, if the steel cord comprises two to five steel filaments having a filament diameter between 0.10 mm and 0.40 mm, the untwisting tension is lower than 25 Newtons, preferably lower than 20 Newtons or 15 Newtons, e.g. about 10 Newtons.

By way of another example, the steel cord may be a high-elongation cord. Such a cord comprises two to seven strands. Each strand comprises two to seven steel filaments with a filament diameter between 0.10 mm and 0.35 mm. The twisting direction of the filaments in a strand is equal to the twisting direction of the strands in the high-elongation cord. The elongation at break of a high-elongation cord conveniently ranges from 5 to 10%.

The steps (i) and (ii) may be done by means of a first false twister. The rotational speed of the overtwister determines the degree of overtwisting, and consequently also the degree of plastically deforming the steel filaments.

Steps (iii) and (iv) may be done by means of a second false twister.

The rotational speed of the second false twister is conveniently smaller than the rotational speed of the first false twister.

As will be explained further in more detail, embodiments are possible where the second false twister rotates in the opposite sense (direction) as the first false twister as well as where the second false twister rotates in the same sense (direction) as the first false twister.

The process may include further steps of straightening the steel cord and/or of rolling the steel cord.

According to a second aspect of the present invention, there is provided for an apparatus for carrying out a treatment of a steel cord to a final twist pitch. The apparatus comprises following successive units:

(i) first twisting means for overtwisting the stell cord under a first tension to a twist pitch that is smaller than the final twist pitch;

(ii) pull-through means for pulling the steel cord through the first means resulting in a second tension downstream which is substantially smaller than the first tension, and;

(iii) second twisting means for untwisting the steel cord under the second tension to a twist pitch that is greater than the final twist pitch.

The pull-through means draws the steel cord through the complete apparatus. Upstream of the pull-through means, the tension must be high enough to compensate for the friction exercised by the upstream part on the steel cord. Downstream of the pull-through means, the tension may be lower, i.e. just high enough to compensate only for the friction exercised by the remaining downstream part of the apparatus on the steel cord.

The first twisting means may comprise a first false twister, the pull-though means a capstan, and the second twisting means a second false twister.

BRIEF DESCRIPTION OF THE DRAWINGS

The invention will now be explained in more detail with reference to the accompanying drawings wherein.

DETAILED DESCRIPTION OF PREFERRED EMBODIMENTS

Figure 1:
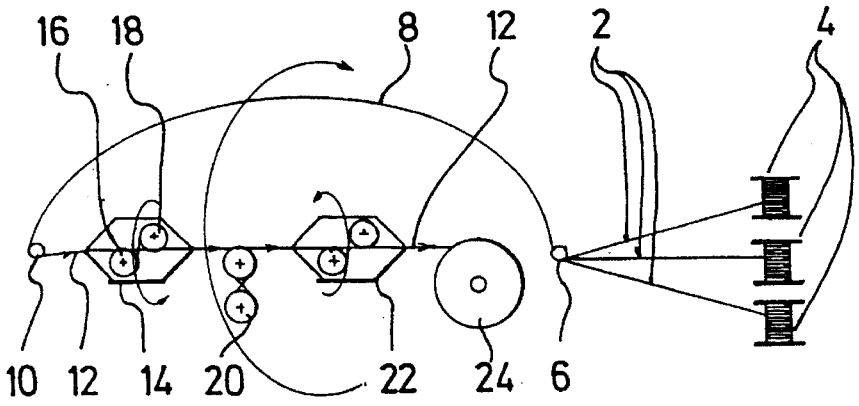
FIG. 1 shows a schematic configuration of a first embodiment of the present invention.

Starting from the right side of FIG. 1, three steel filaments 2 are drawn from three bobbins 4 and are led to a double twister via a guiding pulley 6 where the filaments receive a first torsion. The twisted steel filaments 2 are further guided by means of a flyer 8 to a reversing pulley 10 where the filaments receive a second torsion. After the reversing pulley 10 the steel cord 12 has already obtained its final twist pitch. The steel cord 12 passes through a first false twister 14 which overtwists the steel cord to a twist pitch which is smaller than the final twist pitch and which subsequently untwists the steel cord to the final twist pitch. The false twister 14 may comprise a pair of pulleys 16, 18 around which the steel cord 12 may be wrapped a number of times.

False twisters are known as such in the art. By way of example only, U.S. Pat. No. 3,771,304 describes a false twister functioning as an overtwister.

In the zone immediately upstream from the false twister 14 the twist pitch of the steel cord is decreased, i.e. the radius of curvature of the composing steel filaments 2 is decreased. If the speed of the false twister 14 is high enough with respect to the pull through speed of the steel cord 12, the steel filaments 2 are plastically deformed.

A capstan 20 functions as a drive unit and draws the steel cord 12 through the upstream parts of the apparatus. The tension upstream the capstan 20 is in the range 40 to 70 Newtons, while the tension downstream of the capstan 20 is below half the tension upstream the capstan 20, and may be 10 to 20 Newtons.

A second false twister 22 rotates in the opposite sense (or direction) as the first false twister 14 and partially untwists the steel cord 12 further to a twist pitch which is greater than the final twist and subsequently twists again the steel cord to its final twist pitch. This is done in order to reduce or to control the residual torsions.

As already mentioned hereabove, the untwisting tension is low. In fact, the untwisting tension needs only to be high enough to overcome the friction in the second false twister 22 and in the winding unit 24. This low tension keeps the small radius of curvature of the plastically deformed steel filaments gets lost due to stretching.

Summarizing, the first false twister 14 functions as a controller of the openness, in the case of single-strand steel cords of the 1 xn-type and, in the case of a high-elongation cord, as a controller of the elongation, while the second false twister 22 functions as a controller of the degree of residual torsions. Both function independently of each other as a result of the low tension level under which the second false twister is operating.

Figure 2:
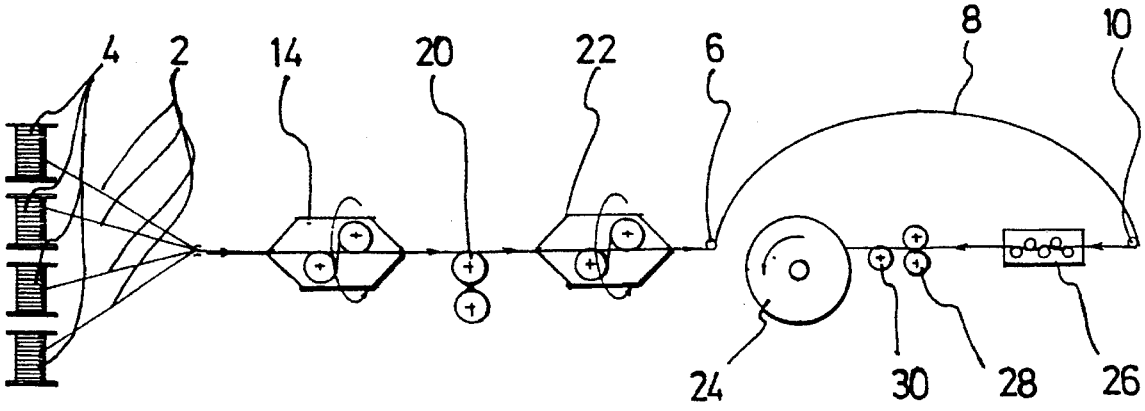
FIG. 2 shows a schematic configuration of a second embodiment of the present invention.

FIG. 2 shows a schematic configuration of another embodiment of the present invention. Starting from the left side, four steel filaments 2 are drawn from the supply bobbins 4 and are guided to a false twister 14 which is a 'first' false twister in the sense as described hereabove. False twister 14 rotates with a rotational speed which is higher than twice the rotational speed of flyer 8 (the rotational speed of flyer 8 determines the final twist pitch). In this way, the steel cord 12 is overtwisted.

Capstan 20 draws the steel cord 12 through the upstream parts of the apparatus. The overtwisting tension upstream of the capstan 20 is in the range 40 to 70 Newtons, the tension downstream the capstan 20 is below half the overtwisting tension, and may be in the range of 10 to 20 Newtons.

The steel cord 12 is further led to still another false twister 22 which is a 'second' false twister in the sense as described hereabove. False twister 22 rotates in the same sense (direction) as false twister 14 but at a speed which is lower than the speed of false twister 14 and lower than twice the rotational speed of flyer 8. The result is that the steel cord 12 is partially untwisted.

The steel cord 12 is then led over a guiding pulley 6, a flyer 8, a reversing pulley 10, a straightener 26, a roller 28 and a capstan 30 to a winding up unit 24. The tension created by the capstan 28 needs only be high enough to compensate for the friction exercised by the parts of the apparatus which are downstream of the first capstan 20 and is substantially lower than the tension created by the first capstan 20. Care must be exercised that the plastic deformation of the steel filaments 12 is not destroyed during the other downstream treatments such as rolling and/or straightening.

As in the embodiment of FIG. 1, false twister 14 functions as a controller of the openness of the steel cord, in the case of single-strand construction of the type 1 xn and, in the case of a high-elongation cord as a controller of the elongation, whereas false twister 22 functions as a controller of the residual torsions of the cord.

We claim:

1. A process of treatment of a steel cord adapted for the reinforcement of rubber products, said steel cord comprising steel filaments which have been twisted to a final twist pitch, said process comprising the steps of:

(i) plastically deforming the steel filaments by overtwisting the steel cord to a twist pitch which is smaller than the final twist pitch;

(ii) untwisting the steel cord to the final twist pitch;

(iii) further untwisting the steel cord to a twist pitch which is greater than the final twist pitch; and (iv) twisting the steel cord again to the final twist pitch, wherein steps (i) and (ii) are done under a first tension and steps (iii) and (iv) are done under a second tension, the second tension being lower than half of the first tension.

2. A process according to claim 1, wherein the steel cord comprises two to five steel filaments having a filament diameter between 0.10 mm and 0.40 mm.

3. A process according to claim 2, wherein the second tension is lower than 25 Newtons.

4. A process according to claim 2, wherein a degree of overtwisting in step (i) is set to determine an elongation of the steel cord at a predetermined tensile tension.

5. A process according to claim 2, wherein a degree of further untwisting in step (iii) is set to determine a final number of residual torsions of the steel cord.

6. A process according to claim 1, wherein the steel cord is a high-elongation cord comprising two to seven strands, each strand comprising two to seven filaments with a filament diameter between 0.10 and 0.35 mm.

7. A process according to claim 6, wherein a degree of overtwisting in step (i) is set to determine a final elongation of the steel cord.

8. A process according to claim 6, wherein a degree of further untwisting in step (iii) is set to determine a final number of residual torsions of the steel cord.

9. A process according to claim 1, wherein steps (i) and (ii) are done by means of a first false twister.

10. A process according to claim 9, wherein steps (iii) and (iv) are done by means of a second false twister.

11. A process according to claim 10, wherein the second false twister rotates in a direction opposite to the first false twister.

12. A process according to claim 10, wherein the second false twister rotates in a same direction as the first false twister.

13. A process according to claim 9, wherein a rotational speed of the second false twister is smaller than a rotational speed of the first false twister.

14. A process according to claim 1, wherein the process comprises a further step of straightening the steel cord.

15. A process according to claim 1, wherein the process comprises a further step of rolling the steel cord.

16. An apparatus for carrying out a treatment of a steel cord, the steel cord having a final twist pitch, said apparatus comprising:

(i) first twisting means for overtwisting said steel cord under a first tension to a twist pitch that is smaller than the final twist pitch;

(ii) pull-through means for pulling said steel cord through said first twisting means resulting in a second tension which is substantially smaller than said first tension;

(iii) second twisting means for untwisting said steel cord under said second tension to a twist pitch that is greater than the final twist pitch; and (iv) final twisting means for twisting said steel cord from the second twisting means to the final twist pitch.

17. An apparatus according to claim 16, wherein the first twisting means comprise a first false twister, the pull-through means comprises a capstan and the untwisting means comprises a second false twister.

* * * * *